United States Patent [19]

Aubry et al.

[11] 4,029,437

[45] June 14, 1977

[54] TURBINE SHAFT HAVING INSERTED DISKS

[75] Inventors: Pierre Aubry; Antoine Marques; Rene Schwartz, all of Belfort, France

[73] Assignee: Groupe Europeen Pour La Technique Des Turbines a Vapeur G.E.T.T., Paris, France

[22] Filed: Dec. 10, 1975

[21] Appl. No.: 639,508

[30] Foreign Application Priority Data

Dec. 16, 1974 France ..... 74.41383

[52] U.S. Cl. ..... 416/198 A; 416/244 A; 403/375

[51] Int. Cl.[2] ..... F01D 5/30

[58] Field of Search ..... 416/244 A, 244, 198–201; 403/375, 121, 343

[56] References Cited

UNITED STATES PATENTS

| | | | |
|---|---|---|---|
| 1,980,337 | 11/1934 | Hollander | 416/198 A X |
| 2,395,704 | 2/1946 | Wislicenus | 416/198 A X |
| 2,660,399 | 11/1953 | Robinson et al. | 416/244 A X |
| 2,901,214 | 8/1959 | Slemmons | 416/244 A |
| 3,070,348 | 12/1962 | Vogel | 416/198 A |
| 3,614,261 | 10/1971 | Friese | 416/244 X |
| 3,645,570 | 2/1972 | Johansson et al. | 403/343 X |
| 3,797,865 | 3/1974 | Ballentine | 403/343 X |

FOREIGN PATENTS OR APPLICATIONS

| | | | |
|---|---|---|---|
| 869,790 | 2/1942 | France | 416/244 A |
| 1,467,755 | 12/1966 | France | 416/244 A |
| 723,882 | 2/1955 | United Kingdom | 416/244 A |

*Primary Examiner*—Everette A. Powell, Jr.
*Attorney, Agent, or Firm*—Sughrue, Rothwell, Mion, Zinn & Macpeak

[57] ABSTRACT

The invention concerns a turbine shaft having stepped bearings on which disks are shrunk on. It is characterized in that the connecting surface between two successive bearings consists of two conical portions separated by a cylindrical portion and toroidal connecting portions between the cylindrical portion and the conical portions. The invention reduces the concentrations of stresses and applies more particularly to elastic fluid turbine shafts.

4 Claims, 2 Drawing Figures

TURBINE SHAFT HAVING INSERTED DISKS

BACKGROUND OF THE INVENTION

1. Field of the Invention

The invention concerns a turbine shaft more particularly an elastic fluid turbine shaft, having a succession of cylindrical bearings arranged in a stepped configuration and on which are installed disks bearing blades on at least one portion of those cylindrical bearings.

DESCRIPTION OF THE PRIOR ART

Great concentrations of stresses occur in the shaft at the separation between two successive cylindrical bearings. An attempt has already been made to reduce those stresses by providing a conical clearance in the rings bearing blades so that their fitting surface on the shaft does not come up to the end of the cylindrical bearings of the shaft and by connecting together two successive cylindrical bearings of the shaft by a connecting surface of revolution having a curved profile and a progressively decreasing diameter from the diameter of that of the two successive cylindrical bearings having the greatest diameter, to the diameter of that of the two successive cylindrical bearings having the smallest diameter, but the zone at the beginning of the rounded part of the profile on the bearing having the smallest diameter, which is a zone greatly affected by the alternate bending stresses of the shaft also happens to be subjected to great shrinking stresses; moreover, that connecting surface causes difficulties in machining.

The invention is intended to obviate those disadvantages by means of a connecting surface which can be more easily machined and by spacing apart from one another the zones subjected to the various stresses.

SUMMARY OF THE INVENTION

For that purpose, it provides a turbine shaft having a succession of cylindrical bearings arranged in a stepped configuration, connected together by connecting surfaces of revolution with the disks shrunk on those cylindrical bearings, characterized in that each of those connecting surfaces of revolution comprises two conical surfaces each starting from one of the two successive cylindrical bearings inclined at an angle of 30° to 60° to the axis of the shaft towards the shaft, axis a cylindrical surface situated between those two conical surfaces and toroidal surfaces connecting the said cylindrical surface respectively to each one of the two conical surfaces.

The said cylindrical surface preferably has a diameter smaller by about 20 mm than the diameter of that of the two successive cylindrical bearings having the smallest diameter.

The two toroidal surfaces are preferably generated by an arc of a circle having a radius of 5 to 25 mm.

With reference to the accompanying diagrammatic figures, an example of embodiment of the invention having no limiting character will be described.

DESCRIPTION OF THE PREFERRED EMBODIMENT

Figure 1:
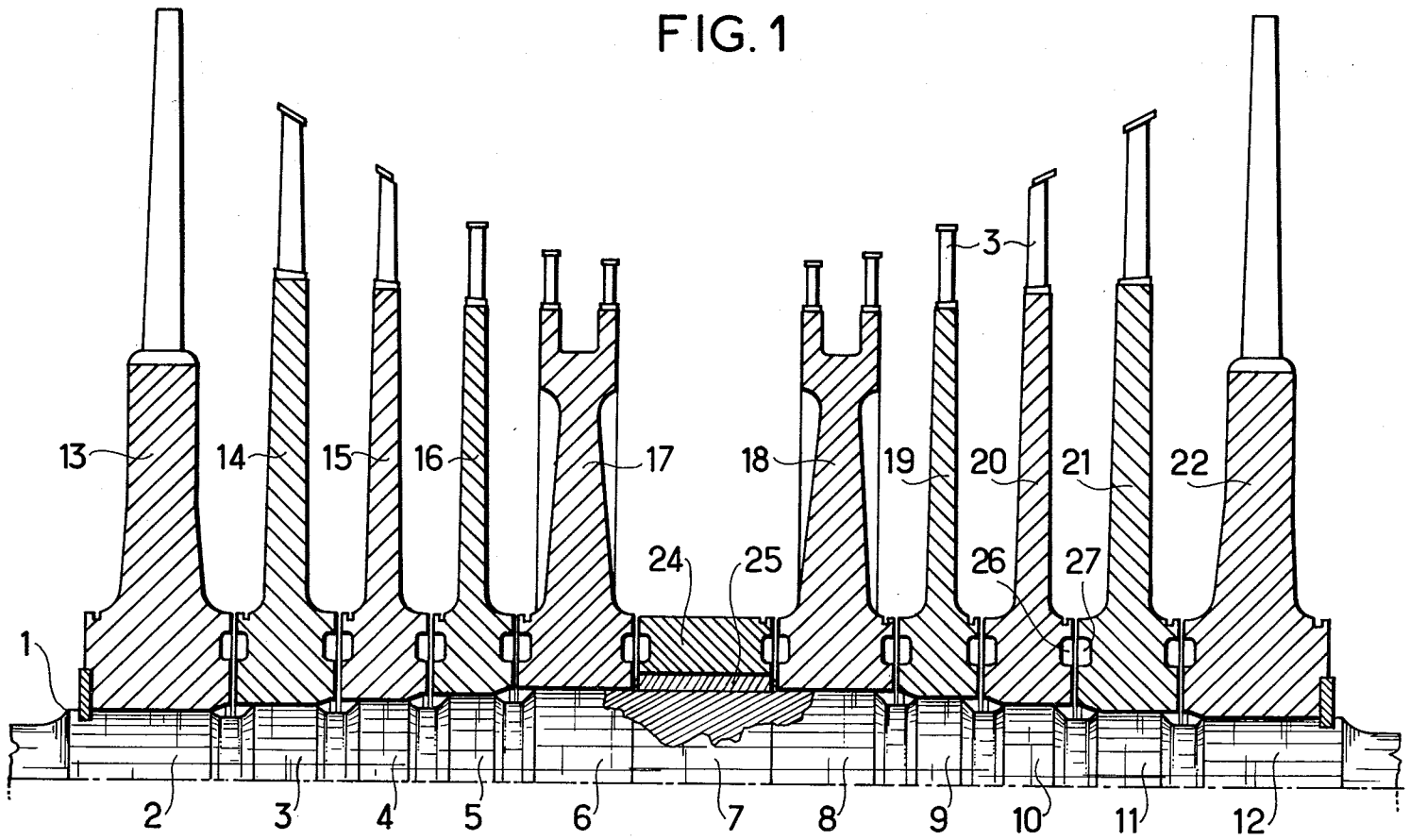
FIG. 1 shows a turbine shaft with disks shrunk onto the shaft, in a partial axial cross-section view.

In FIG. 1, a steam turbine shaft 1 consists of a succession of cylindrical bearings 2 to 12 each having a disk (13 to 22) bearing blades such as 23, shrunk onto the shaft, or a drive ring 24 keyed at 25 to the shaft 1, the disks and rings being connected to each other by connecting parts 26, 27.

Figure 2:
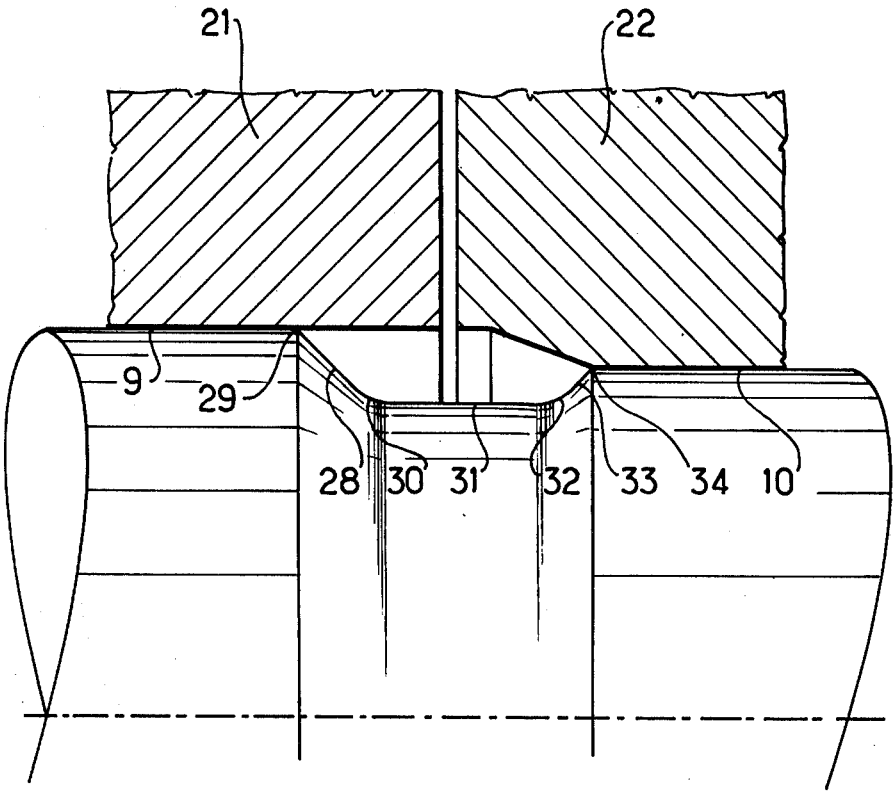
FIG. 2 shows, on a larger scale, the connecting between two stepped cylindrical bearings of the shaft.

Each cylindrical bearing is connected to the neighbouring cylindrical bearing of the shaft by connecting surface which can be seen better in FIG. 2, which shows the connection between the cylindrical bearings 9 and 10 of the shaft, for example.

That connecting surface consists of a conical portion 28 starting at 29 from the bearing 9 and being inclined at 45° to the axis of the shaft 1, a small toroidal portion 30 in which the radius of the arc of the generating circle is 20 mm, a cylindrical portion 31, a small toroidal portion 32 in which the radius of the arc of the generating circle is 20 mm and a conical portion 33 inclined at 45° to the axis of the shaft 1 which ends at 34 on the cylindrical bearing 10. The diameter of the cylindrical portion 31 is smaller than the diameter of the bearing 10 by 20 mm.

Instead of the connecting between the bearings 9 and 10 which has up till now been used, which would consist of a surface of revolution generated by a curve which would join 29 to 34, coming progressively closer to the axis of the shaft 1, the invention has the advantage of separating the zones of high alternate bending stress situated at the connections of the toroidal portions 32 and 33 from the zones greatly affected by the shrinking stresses, situated on the bearings 9 and 10; moreover, machining can easily be effected by turning, large forming surfaces being dispensed with.

We claim:

1. In a turbine shaft having a succession of cylindrical bearings arranged in a stepped configuration, connected together by connecting surfaces of revolution and wherein a single disk is shrunk onto each cylindrical bearing and is unconnected to adjacent disks except through said shaft, the improvement wherein: each of said connecting surfaces of revolution comprises two conical surfaces, each of said conical surfaces starting from a respective one of the two successive cylindrical bearings being inclined at an angle of 30° to 60° to the axis of the shaft and tapering towards the axis of the shaft, a cylindrical surface being situated between said pair of conical surfaces and two toroidal surfaces connecting said cylindrical surface respectively to each one of the two conical surfaces, whereby, the zones of the shaft affected by shrinking stresses due to the shrinking of the individual disks to the individual cylindrical bearings is effectively separated from the zones affected by alternate bending stresses which lie intermediate of those zones affected by said shrinking stresses.

2. The turbine shaft according to claim 1, wherein said cylindrical surface has a diameter smaller by about 20 mm than the diameter of that one of the two successive cylindrical bearings having the smallest diameter.

3. The turbine shaft according to claim 1, wherein the two toroidal surfaces are generated by an arc of a circle having a radius of 5 to 25 mm.

4. The turbine shaft according to claim 2, wherein the two toroidal surfaces are generated by an arc of a circle having a radius of 5 to 25 mm.

* * * * *